US008062184B2

(12) United States Patent
Brandenburg

(10) Patent No.: US 8,062,184 B2
(45) Date of Patent: Nov. 22, 2011

(54) PRESS BARS FOR WEIGHTLIFTING EXERCISES AND RELATED METHODS FOR USING THEM

(76) Inventor: Michael Brandenburg, Seattle, WA (US)

( * ) Notice: Subject to any disclaimer, the term of this patent is extended or adjusted under 35 U.S.C. 154(b) by 0 days.

(21) Appl. No.: 12/657,811

(22) Filed: Jan. 28, 2010

(65) Prior Publication Data

US 2010/0323854 A1 Dec. 23, 2010

Related U.S. Application Data

(60) Provisional application No. 61/268,940, filed on Jun. 18, 2009.

(51) Int. Cl.
*A63B 21/00* (2006.01)

(52) U.S. Cl. ..... 482/49; 482/46; 482/45

(58) Field of Classification Search ..... 482/106, 482/107, 105

See application file for complete search history.

(56) References Cited

U.S. PATENT DOCUMENTS

D320,636 S * 10/1991 Eckler ..... D21/681
5,080,349 A * 1/1992 Vittone ..... 482/106

* cited by examiner

*Primary Examiner* — Jerome w Donnelly
(74) *Attorney, Agent, or Firm* — Janeway Patent Law

(57) ABSTRACT

A press bar for supporting a weight during a weightlifting exercise includes a body that has a first end, a second end, and a body-axis that passes through the first and second ends, wherein the body-axis is substantially horizontal when the press bar lies on a substantially horizontal surface. In addition to the body, the press bar includes a handle connected to the body. The handle includes a grip positioned relative to the body-axis. The grip has a longitudinal axis lying in a plane that is vertical when the press bar lies on a substantially horizontal surface. The position of the grip relative to the body-axis is such that the body-axis does not intersect the grip, but does intersect the plane at an angle between 45° and 135°.

16 Claims, 3 Drawing Sheets

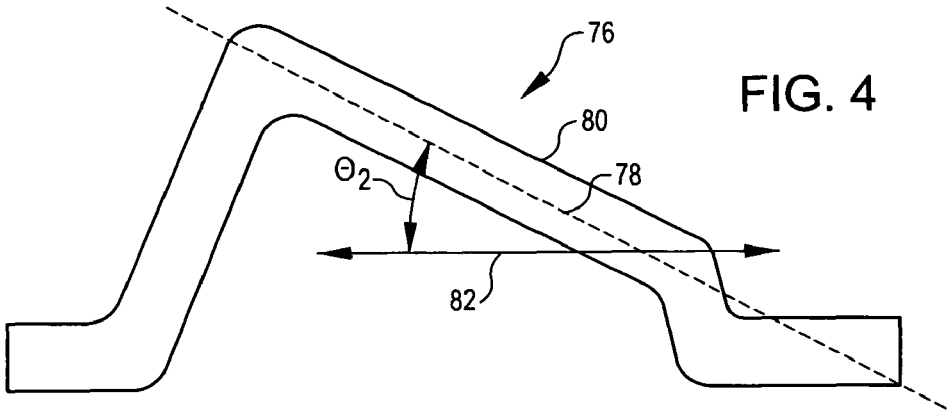
FIG. 4
FIG. 5
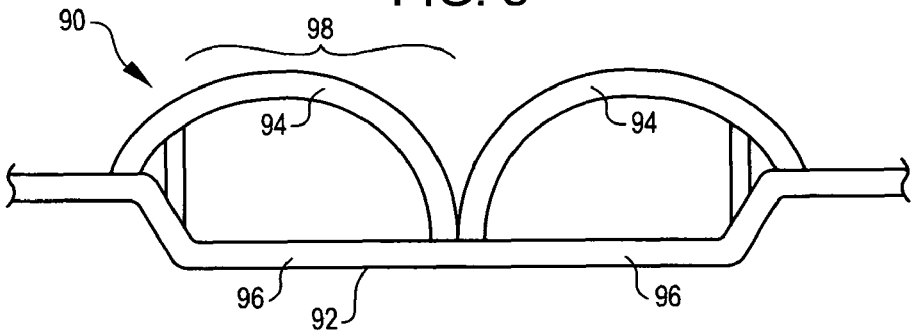
FIG. 6
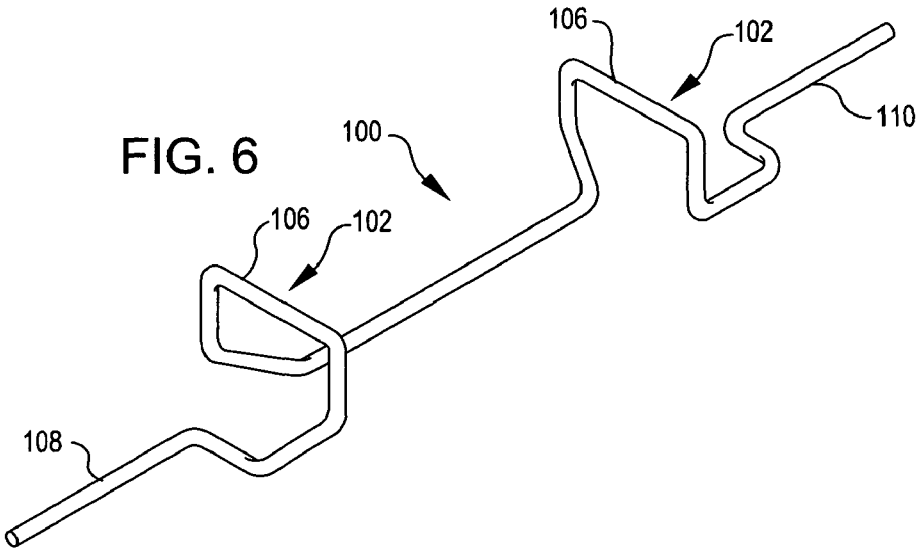

PRESS BARS FOR WEIGHTLIFTING EXERCISES AND RELATED METHODS FOR USING THEM

CROSS REFERENCE TO RELATED APPLICATION AND PRIORITY CLAIM

This application claims priority from provisional application No. 61/268,940 filed on 18 Jun. 2009, titled Press Bars and Related Methods for Using Them, and which is incorporated herein by reference.

BACKGROUND

Many people exercise to improve their health and/or physique, and often, such exercise includes lifting weights. Lifting weights can be done with the aid of a machine, such as a nautilus and/or universal gym; or with the aid of a bar that is free—not connected to or confined by a machine—that one grasps and moves relative to a portion of one's body, such as one's chest for a bench press. To lift the desired weight for a desired number of repetitions, one or more weights can be releasably attached to the bar. Exercises that include moving the free bar, also known as a press bar (20 in FIGS. 1A-1C), with or without an attached weight 22 (two shown attached to a bar 20) are commonly referred to as free-weight exercises. Each of the three figures, FIGS. 1A-1C, respectively shows an example of three common free-weight exercises—the bench press, military press, and squat.

Many exercise programs include free-weight exercises because one uses more muscles in one's arms, back and legs during the lifting to stabilize the bar 20 than one uses when lifting with a nautilus (not shown) and/or universal gym (not shown). Unfortunately, in these and other free-weight exercises, pushing against the press bar 20 to lift or hold one or more weights can cause pain in and/or damage one's wrists, elbows, shoulders and/or back because grasping the press bar 20 with both hands as show in FIGS. 1A-1C causes the wrist, elbow, and shoulder of each arm to not be aligned in an anatomically proper alignment for pushing. An anatomically proper alignment for pushing against the press bar includes positioning the elbow closer to the body to keep the humerus, clavical and scapula bones (not shown) and their corresponding muscles, tendons and ligaments (not shown) that comprise the shoulder in an alignment that provides optimal blood flow and power. The anatomically proper alignment also includes positioning each hand so that it opens toward the other hand.

In addition to improper anatomical alignment of one's arm, pushing against the press bar 20 to lift a large amount of weight can be difficult because the press bar and weight can be difficult to stabilize within one's grip. Pushing against the press bar 20 at a position that is level with or below the bar and weight's center of gravity urges the press bar 20 to rotate in one's grip, and/or roll over one's wrist. The center of gravity is the point at which the entire weight of the press bar 20 and any attached weights 22 may be considered as concentrated so that if supported at this point the press bar 20 and attached weights 22 would remain in equilibrium in any position. To prevent the rotation and/or rolling, one tightly grips the press bar 20 and focuses on adjusting the direction of one's push. Thus, the conventional press bar can be difficult to hold onto during a free-weight exercise.

SUMMARY

In one aspect of the invention, a press bar for supporting a weight during a weightlifting exercise includes a body that has a first end, a second end, and a body-axis that passes through the first and second ends, wherein the body-axis is substantially horizontal when the press bar lies on a substantially horizontal surface. In addition to the body, the press bar includes a handle connected to the body. The handle includes a grip positioned relative to the body-axis. The grip has a longitudinal axis lying in a plane that is vertical when the press bar lies on a substantially horizontal surface. The position of the grip relative to the body-axis is such that the body-axis does not intersect the grip, but does intersect the plane at an angle between 45° and 90°.

With this positioning of the handle's grip relative to the body-axis of the press bar's body, the anatomical alignment of one's wrist, elbow, and shoulder is more proper while pushing against the press bar to perform a free-weight exercise than the anatomical alignment of one's wrist, elbow, and shoulder while pushing against a conventional press bar 20 (FIGS. 1A-1C). Furthermore, if the handle's grip is located above the center of gravity of the press bar and any attached weight while one pushes against the press bar, the press bar will not tend to rotate in one's grip, and will not trend to roll over one's wrist. Thus, one does not have to grip the press bar as tightly as one would the press bar 20 (FIGS. 1A-1C), and does not have to concentrate so much on adjusting one's pushing direction while one performs a free-weight exercise.

BRIEF DESCRIPTION OF THE DRAWINGS

FIG. 4 shows a side view of a press bar's handle, according to an embodiment of the invention.

FIG. 5 shows a plan view of a press bar, according to another embodiment of the invention.

FIG. 6 shows a perspective view of a press bar, according to yet another embodiment of the invention.

DETAILED DESCRIPTION

Figure 1A:
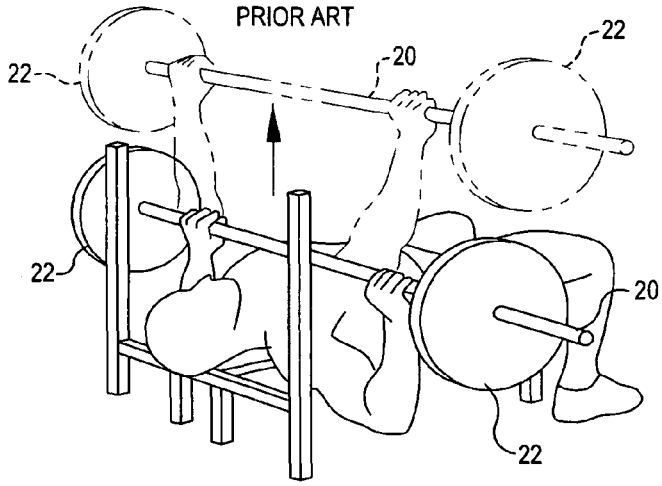
FIG. 1A PRIOR ART
FIGS. 1A-1C show a respective one of the following three common free-weight exercises—the bench press, military press, and squat, and the grip on a conventional press bar while each exercise is performed.
Figure 1C:
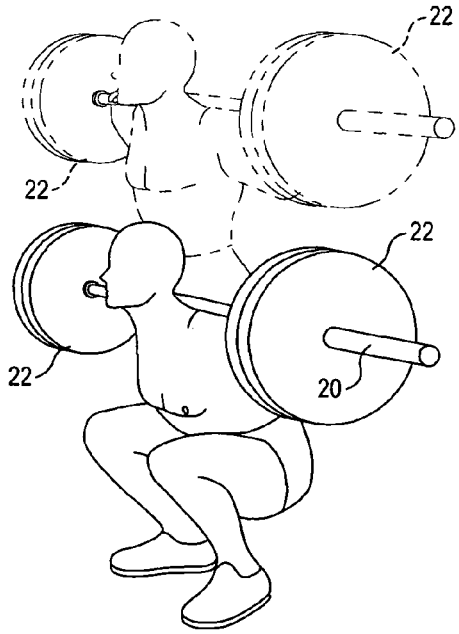
FIG. 1C PRIOR ART
Figure 2:
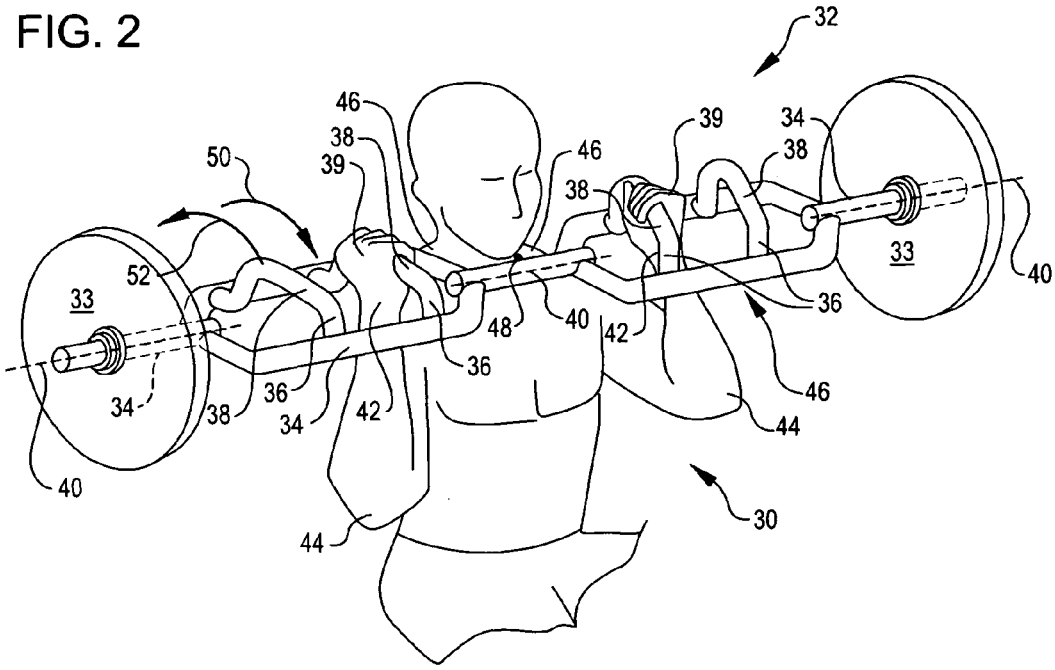
FIG. 2 shows a military press, free-weight exercise performed with a press bar, according to an embodiment of the invention.

FIG. 2 shows a person 30 performing a military press, free-weight exercise with a press bar 32 and two weights 33 attached to the bar 32, according to an embodiment of the invention. Although the press bar 32 is shown being used to perform a military press, the bar 32 may also be used to perform other common free-weight exercises, such as a bench press (shown in FIG. 1A) and a squat (shown in FIG. 1C). The press bar 32 includes a body 34 and a handle 36 (here four shown—two of which may be gripped by the left hand and two of which may be gripped by the right hand) connected to the body 34. The handle 36 includes a grip 38 (here four shown—two of which may be gripped by the left hand and two of which may be gripped by the right hand) that is positioned relative to the body-axis 40 of the body 34 such that the body-axis 40 does not intersect the grip 38, and the hands 39 of the person open up toward each other (discussed in greater detail in conjunction with FIG. 3).

Figure 1B:
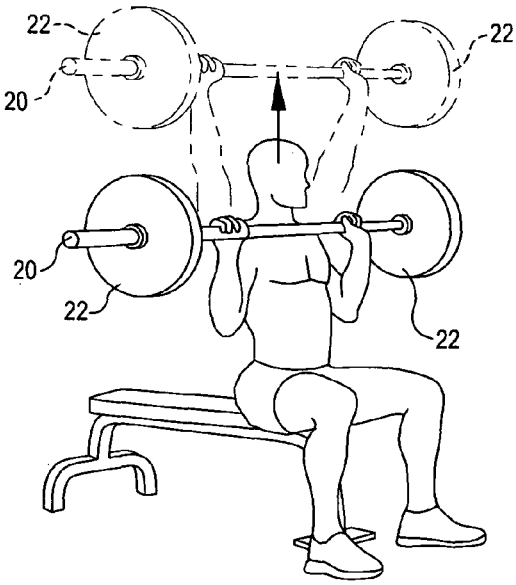
FIG. 1B PRIOR ART

With the grip 38 so positioned, the anatomical alignment of the person's wrist 42, elbow 44, and shoulder 46 is more proper while pushing against the press bar 32 to perform a free-weight exercise (here a common military press) than the anatomical alignment of the wrist, elbow, and shoulder while pushing against the conventional press bar 20 in FIGS. 1A-1C. Furthermore, because the handle's grip 38 is located above the body-axis 40 while the person 30 pushes against the bar 32 to perform the military press, the center of gravity 48 for the combination of the bar 32 and weight 33 is located below the grip. Thus, while pushing against the bar 32, the bar 32 will not tend to rotate about the body-axis 40, and thus not slip in the person's grip nor cause the person's wrists 42 to rotate forward in the direction of the arrow 50 or backward in the direction of the arrow 52. Thus, the person 30 does not have to grip the press bar 32 as tightly as one would the press bar 20 in FIGS. 1A-1C, and does not have to concentrate so much on adjusting his pushing direction while performing the military press.

Figure 3:
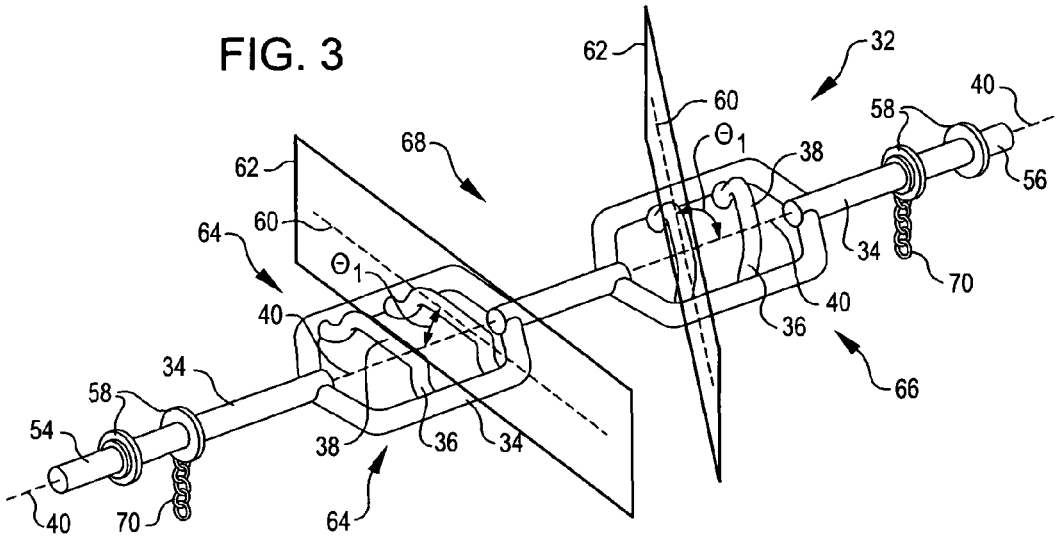
FIG. 3 shows a perspective view of the press bar shown in FIG. 2, according to an embodiment of the invention.

FIG. 3 shows a perspective view of the press bar 32 shown in FIG. 2, according to an embodiment of the invention. The body 34 of the press bar 32 includes a first end 54 for locating one or more removable weights 33 in FIG. 2 (omitted from FIG. 3 for clarity), a second end 56 for locating an additional one or more removable weights 33, and collars 58 for releasably holding the one or more weights 33 to the press bar 34. The body 34 also includes the body-axis 40, and is configured such that the body-axis 40 passes through both the first end 54 and the second end 56. In this and certain other embodiments, the press bar 32 includes four handles 36 (only two labeled for clarity) connected to the body 34. Each handle 36 includes a respective one of the four grips 38 (only two labeled for clarity). Each grip 38 has a longitudinal axis 60 (only two shown for clarity) that lies in a respective plane 62 (only two shown for clarity). In other embodiments, the press bar 32 may include one, two, three, or more than four handles 36.

Each handle 36 may be formed in any desired manner that, when connected to the body 34, positions its respective grip 38 such that the body-axis 40 does not intersect the grip 38. For example, in this and certain other embodiments, each of the four handles are shaped like a flat bottomed "U", and connected to the body 34 at the open end of the "U". Each of the grips 38 includes the flat bottom portion of the "U". When the handles 36 are connected to the body 34, the body-axis 40 intersects the respective planes 62 at an angle $\theta_1$, and at a location that does not include the grip 38.

Still referring to FIG. 3, the angle $\theta_1$ may be any desired angle between 45° and 135°, inclusive. For example, in this and certain other embodiments, the angle $\theta_1$ is 80°. In other embodiments, the angle $\theta_1$ may be 60°. In still other embodiments the angle $\theta_1$ may be 90°.

Still referring to FIG. 3, each handle 36 may be connected to the body 34 in any desired manner. For example, in this and other embodiments, each handle 36 is welded to the body 34 using conventional welding techniques. In other embodiments, a handle 36 may be connected to the body 34 using conventional mechanical fastening techniques, such as a bolt and nut. In still other embodiments, a handle 36 may be releasably connected to the body 34 using conventional fastening techniques, such as a bolt and cotter pin. Releasably connecting the handle 36 to the body 34 may be desired to allow one to adjust the spacing between two or more handles 36, and/or the angle $\theta_1$ that the plane 62 intersects the body-axis 40 at.

Still referring to FIG. 3, the distance between the handle 36 that person grasps with his right hand and the handle 36 that the person grasps with his left hand may be any desired distance. For example, in this and certain other embodiments the distance is 26 inches to allow each hand of a person with broad shoulders to be properly aligned with the humerus, clavical and scapula bones (not shown) and their corresponding muscles, tendons and ligaments (not shown) of a respective one of the person's shoulder joints. In other embodiments, the distance between the handle that the person grasps with his right hand and the handle that the person grasps with his left hand may be 20 inches to allow each hand of a person with narrower shoulders to be properly aligned with a respective one of the person's shoulder joints.

Still referring to FIG. 3, each grip 38 may have any desired shape. For example, in this and certain other embodiments, the shape of each grip 38 is a cylinder having a radius of 2.5 inches. In addition, the longitudinal axis 60 of each grip 38 is co-linear with the cylinder's central axis. In other embodiments, a grip 38 may have a cylindrical shape whose radius is 3 inches to accommodate a person who has larger hands. In still other embodiments, the shape of a grip 38 may be oval to accommodate the natural contours of a person's hand as the person grips the handle 36.

Still referring to FIG. 3, the body 34 may have any desired shape. For example, in this and certain other embodiments, the body 34 includes a first cage 64 that two of the four handles 36 are connected to, a second cage 66 that the other remaining handles 36 are attached to, and a central portion 68 located between the first cage 64 and the second cage 66 that the body-axis 40 also passes through. In other embodiments, the central portion may be located between the first and second cages 64 and 66, such that the body-axis 40 does not pass through it. This may desirable to provide more clearance for a person's face while the person performs a military press with the bar 32, for a person's chin while the person performs a bench press with the bar 32, or a person's head while the person performs a squat with the bar 32.

Still referring to FIG. 3, the body 34 and each of the handles 36 may include any desired material capable of supporting, during a free-weight exercise, the one or more weights 33 that person may want to releasably attach to the bar 32. For example, in this and certain other embodiments, the body 34 and each handle 36 includes steel. In other embodiments, the body 34 and a handle 36 may include aluminum, and/or a composite material such as carbon, Kevlar® and/or fiberglass fibers woven and glued together.

Still referring to FIG. 3, each collar 58 may include a hole (not show) for attaching a chain 70, elastic (not shown) or any other variable resistance element that adds to the force that a person overcomes when moving the bar 32 during a free-weight exercise. The variable resistance element is different than the one or more weights 33 because the amount of force that they apply to the bar 32 depends on the location of the bar during the exercise. For example, if a long chain 70 is attached to the bar 32 and one uses the bar 32 to perform a bench press, then the weight of the chain increases as more chain links are lifted off the floor (not shown) and supported by the bar 32. Similarly, an elastic that is attached to the bar 32 and secured to a floor, increases its pull against the bar 32 as the bar 32 is moved away from the floor during a military press.

FIG. 4 shows a side view of a handle 76, according to an embodiment of the invention. The handle 76 is similar to the handle 36 in FIG. 3 except that the handle 76 is shaped such that the longitudinal axis 78 of the grip 80 is not parallel to the substantially horizontal surface (here represented by the arrow 82) when the press bar (such as the press bar 32 in FIGS. 2 and 3) that the handle 76 is connected to lies on a substantially horizontal surface. With the grip 80 tilted at an angle $\theta_2$ such that its longitudinal axis is not parallel with a horizontal surface when the press bar that the handle 76 is attached to lies on a substantially horizontal surface, one may maintain control of the bar and any supported weights while causing less stress on his or her wrists than may otherwise be caused. When this tilt is combined with the position of the grip discussed in conjunction with FIG. 3, the total amount of stress placed on the user's wrists, shoulders, and other body parts in motion during free-weight exercises may be significantly reduced relative to the total amount of stress placed when using the conventional press bar 20 (FIGS. 1A-1C).

The angle $\theta_2$ may be any desired angle 0° and 45°, inclusive. For example, in this and certain other embodiments, the angle $\theta_2$ is 25°. In other embodiments, the angle $\theta_2$ may be 15°.

FIG. 5 shows a plan view of a press bar 90, according to another embodiment of the invention. The press bar 90 includes a body 92 that has a curved portion 94 (here two) where a handle (omitted for clarity), such as the handle 36 in FIGS. 2 and 3, or handle 76 in FIG. 4, is connected to the body 92. The body 92 also includes a handle pivot region 96 (here two) that, when a handle is connected to the region 96, the handle may be connected anywhere along a respective region 98 (only one labeled for clarity) of the curved portion 94. In this manner, one can change the angle $\theta_1$ that helps define the position of the handle relative to the body 92, and thus change the position of the handle relative to the body 92 to accommodate a user's comfort and/or change in the desired anatomical alignment associated with a different free-weight exercise.

FIG. 6 shows a perspective view of a press bar 100, according to another embodiment of the invention. The press bar 100 includes a handle 102 (here two) that is an integral part of the body 104, and a grip 106 (here two). The body 104 includes a first end 108 and a second end 110, each of which is configured to locate one or more weights (33 in FIGS. 2 and 3), and to secure the weights with collars (not shown), such as collars 58 in FIGS. 2 and 3.

What is claimed is:

1. A press bar for supporting a weight during a weightlifting exercise, the press bar comprising:

a body having a first end, a second end, and a body-axis that passes through the first and second ends, wherein the body-axis is substantially horizontal when the press bar lies on a substantially horizontal surface; and a handle connected to the body and including a grip positioned relative to the body-axis, the grip having a longitudinal axis lying in a plane that is vertical when the press bar lies on a substantially horizontal surface, the position of the grip relative to the body-axis being such that the body-axis does not intersect the grip, but does intersect the plane at an angle between 45° and 135°, and wherein the grip's longitudinal axis intersects the substantially horizontal surface at an angle between 0° and 45° when the press bar lies on a substantially horizontal surface.

2. The press bar of claim 1 further comprising a second handle connected to the body and including a grip positioned relative to the body-axis, the second handle's grip having a longitudinal axis lying in a second plane that is vertical when the press bar lies on a substantially horizontal surface, the position of the second handle's grip relative to the body-axis being such that the body-axis does not intersect the second handle's grip, but does intersect the second plane at an angle between 45° and 135°.

3. The press bar of claim 1 wherein the body is configured to provide clearance for a person's head when the person uses the press bar to perform a military press weightlifting exercise.

4. The press bar of claim 1 wherein the body is configured to provide clearance for a person's head when the person uses the press bar to perform a squat weightlifting exercise.

5. The press bar of claim 1 wherein the body includes a cage, and the handle is connected to the cage.

6. The press bar of claim 2 wherein the body includes:

a first cage that the handle is connected to; and a second cage that the second handle is connected to.

7. The press bar of claim 1 wherein the grip of the handle, is cylindrical or substantially cylindrical.

8. The press bar of claim 1 wherein the grip of the handle is cylindrical or substantially cylindrical, and the longitudinal axis includes the longitudinal axis of the grip's cylindrical or substantially cylindrical shape.

9. The press bar of claim 2 wherein each grip is positioned relative to the body-axis such that the longitudinal axis of each grip intersects the substantially horizontal surface at an angle of 25° or substantially 25°.

10. A method for making a press bar for supporting a weight during a weightlifting exercise, the method comprising:

forming a first end of a body and a second end of the body such that a body-axis that is substantially horizontal when the press bar lies on a substantially horizontal surface, passes through the first and second ends;

forming a grip of a handle for holding the press bar, the grip having a longitudinal axis that lies in a plane that is vertical when the press bar lies on a substantially horizontal surface; and positioning the grip relative to the body-axis such that the body-axis does not intersect the grip, but does intersect the plane at an angle between 45° and 135°, and the longitudinal axis of each grip intersects the substantially horizontal surface at an angle between 0° and 45°.

11. The method of claim 10 further comprising:

forming a grip of a second handle for holding the press bar, the second handle's grip having a longitudinal axis that lies in a second plane that is vertical when the press bar lies on a substantially horizontal surface; and positioning the grip of the second handle relative to the body-axis such that the body-axis does not intersect the grip, but does intersect the plane at an angle between 45° and 135°.

12. The method of claim 11 wherein positioning each grip relative to the body-axis includes positioning each grip such that the longitudinal axis of each grip intersects the substantially horizontal surface at an angle of 25° or substantially 25°.

13. A method for lifting a weight during a weightlifting exercise, the method comprising:

grasping a grip of a handle of a press bar, wherein the press bar includes a body having a first end, a second end, and a body-axis that passes through the first and second ends, wherein the body-axis is substantially horizontal when the press bar lies on a substantially horizontal surface, wherein the grip has a longitudinal axis lying in a plane that is vertical when the press bar lies on a substantially horizontal surface, and wherein the grip is positioned relative to the body-axis such that the body-axis does not intersect the grip, but does intersect the plane at an angle between 45° and 135, and the grip's longitudinal axis intersects the substantially horizontal surface at an angle between 0° and 45°;

moving the press bar.

14. The method of claim 13 further comprising grasping a grip of a second handle of the press bar, wherein the grip of the second handle has a longitudinal axis lying in a second plane that is vertical when the press bar lies on a substantially horizontal surface, and wherein the grip of the second handle is positioned relative to the body-axis such that the body-axis does not intersect the grip, but does intersect the plane at an angle between 45° and 135°.

15. The method of claim 13 wherein moving the press bar includes orienting the press bar relative to the direction of gravity's force such that the grip is above the body axis.

16. The method of claim 13 wherein moving the press bar includes extending an arm away from one's body.

* * * * *